United States Patent [19]

Sato et al.

[11] Patent Number: 4,541,393

[45] Date of Patent: Sep. 17, 1985

[54] APPARATUS FOR CONTROLLING FUEL INJECTION TIMING

[75] Inventors: Fumihide Sato, Oyama; Toyoichi Ono, Isehara, both of Japan

[73] Assignee: Kabushiki Kaisha Komatsu Seisakusho, Tokyo, Japan

[21] Appl. No.: 508,099

[22] Filed: Jun. 27, 1983

[30] Foreign Application Priority Data

Jun. 30, 1982 [JP] Japan ..... 57-097254[U]

[51] Int. Cl.[4] ..... F02M 59/20

[52] U.S. Cl. ..... 123/502; 123/501

[58] Field of Search ..... 123/501, 502; 73/119 A

[56] References Cited

U.S. PATENT DOCUMENTS

| | | | |
|---|---|---|---|
| 2,270,410 | 1/1942 | Camner | 123/501 |
| 2,703,563 | 3/1955 | Hancock | 123/501 |
| 3,815,564 | 6/1974 | Suda et al. | 123/501 |
| 4,142,498 | 3/1979 | Hammond | 123/501 |
| 4,305,366 | 12/1981 | Imasato et al. | 123/501 |
| 4,369,651 | 1/1983 | Szentes | 73/119 A |
| 4,417,554 | 11/1983 | Dinger | 123/501 |

FOREIGN PATENT DOCUMENTS

| | | | |
|---|---|---|---|
| 75961 | 6/1981 | Japan | 123/501 |
| 68536 | 4/1982 | Japan | 123/502 |
| 157022 | 9/1982 | Japan | 123/502 |

*Primary Examiner*—Magdalen Y. C. Moy

*Attorney, Agent, or Firm*—Armstrong, Nikaido, Marmelstein & Kubovcik

[57] ABSTRACT

A fuel injection timing control apparatus is disclosed, which comprises a fuel injection timing control mechanism including an input and an output shaft respectively with a first and a fourth gear, at least one of these gears being a helical gear, and an axially movable shaft with a second and a third gear respectively in mesh with the first and fourth gears, a piston-cylinder assembly with a piston rod coupled to the axially movable shaft, and a piston-cylinder assembly control mechanism having detector means for detecting the phases of the first and fourth gears. The phase relation between the first and fourth gears is varied with displacement of the second and third gears caused through control of the piston-cylinder assembly according to the difference between a reference phase angle and a detected phase angle.

2 Claims, 6 Drawing Figures

APPARATUS FOR CONTROLLING FUEL INJECTION TIMING

BACKGROUND OF THE INVENTION

1. Field of the Invention

This invention relates generally to the control of fuel injection timing and, more particularly, to an apparatus which can accurately control the fuel injection timing.

2. Prior Art

A prior art fuel injection timing control apparatus has an input shaft coupled to the engine crankshaft and an output coupled to the rotary valve spool of a fuel injection mechanism. The input and output shafts respectively carry constantly rotating gears, which must be in a fixed rotational phase relation to each other. With the fuel injection timing control apparatus of the type noted, however, a departure from the regular rotational phase relation between the two constantly rotating gears is liable, and this would spoil the proper fuel injection timing, and hence the engine performance.

SUMMARY OF THE INVENTION

An object of the invention is to provide a fuel injection timing control apparatus, which can control the fuel injection timing reliably and accurately.

According to the invention, there is provided a fuel injection timing control apparatus, which comprises a fuel injection timing control mechanism having a body supporting input and output shafts respectively carrying first and fourth gears and an axially movable shaft coupled to a fuel injection mechanism, the axially movable shaft being parallel with the input and output shafts and carrying second and third gears in mesh with the respective first and fourth gears, at least either one of the first and fourth gears being a helical gear, a piston-cylinder assembly provided in the body and having a piston rod coupled to the auxiliary movable shaft, and a piston-cylinder assembly control mechanism including two detectors for detecting the phases of teeth of the respective first and fourth gears and producing corresponding gear phase outputs and solenoid valve means controlled according to the difference between the two gear phase outputs to control the flow of operating fluid into and out of the piston-cylinder assembly.

DESCRIPTION OF THE PREFERRED EMBODIMENTS

Figure 1:
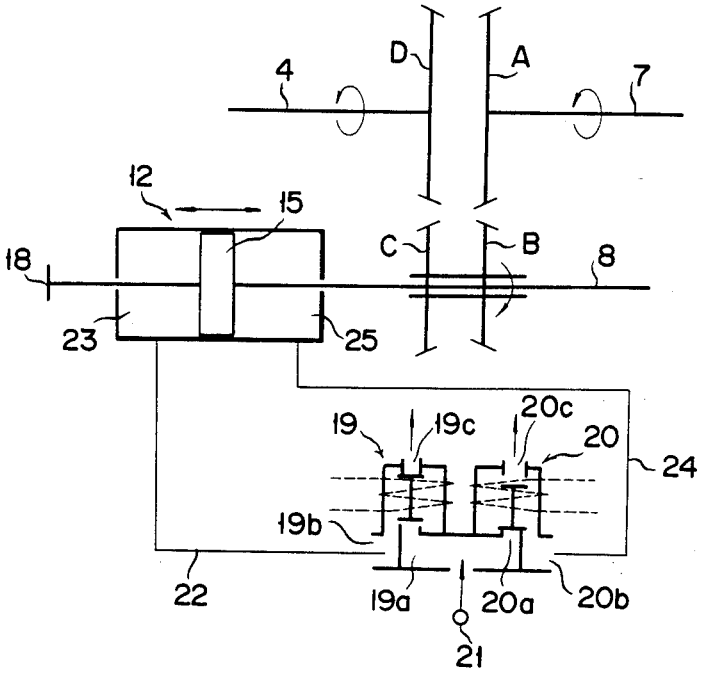
FIG. 1 is a schematic view showing an embodiment of the fuel injection timing control apparatus according to the invention.
Figure 2:
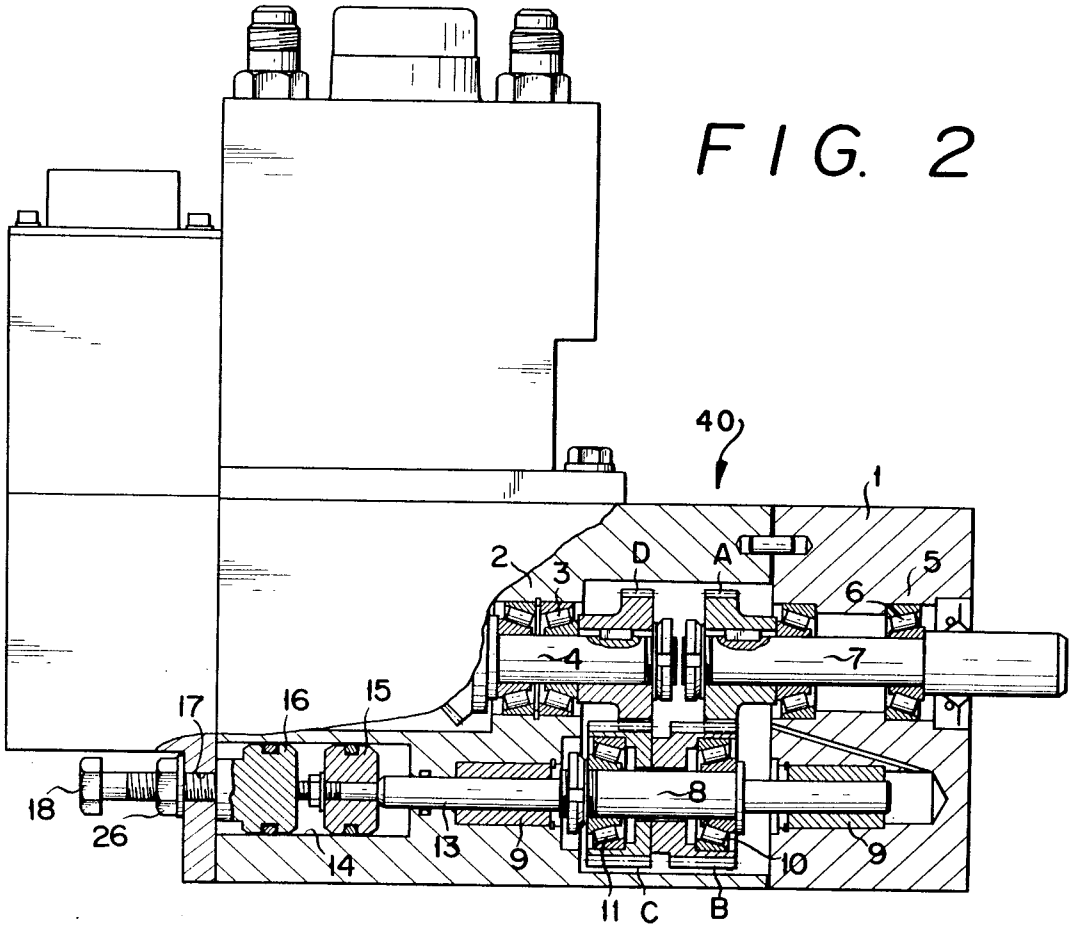
FIG. 2 is a side view, partly in section, showing a fuel injection timing control mechanism of the same embodiment.

Referring to FIGS. 1 and 2, there is shown a first embodiment of the fuel injection timing control apparatus according to the invention. The apparatus comprises a fuel injection timing control mechanism 40, which has a body 1 having shaft support sections 2 and 5 in which output and input shafts 4 and 7 are supported via bearings 3 and 6 respectively.

The input shaft 7 has a first gear A secured thereto, and the output shaft 4 has a fourth gear D secured thereto.

The output shaft 4 is coupled to a fuel injection mechanism.

A further shaft 8 is supported in the body 1 via bearings 9 such that it extends parallel to the input and output shafts 7 and 4. It is axially movable as well as rotatable. Second and third gears B and C are supported on the shaft 8 via respective bearings 10 and 11. The second gear B is meshing with the first gear A, while the third gear C is meshing with the fourth gear D.

Of the first and fourth gears A and D, either one may be a helical gear while the other may be a spur gear. Alternatively, both the gears may be herical gears.

A piston-cylinder assembly 12 is provided in the body 1 with its piston rod 13 coupled to the shaft 8. It has a drive piston 15 and a free piston 16, these pistons being provided separately in a cylinder 14. An end wall defining the cylinder 14 is formed with a threaded hole 17. A set bolt 18 is screwed in the threaded hole 18. A nut 26 is fitted on the set bolt 18.

Reference numerals 19 and 20 in FIG. 1 designate solenoid valves. In this embodiment, these solenoid valves are three-way valves. The inlet ports 19*a* and 20*a* of the three-way valves 19 and 20 are communicated with an oil hydraulic driving pressure source 21. The outlet port 19*b* of the three-way valve 12 is communicated with a head side section 23 of the piston-cylinder assembly 12 through a duct line 22. The other outlet port 19*c* of the three-way valve 19 is communicated with a tank. The outlet port 20*b* of the other three-way valve 20 is communicated with a rod side section 25 of the piston-cylinder assembly 12 through a duct line 24. The other outlet port 20*c* of the three-way valve 20 is communicated with the tank.

Figure 3:
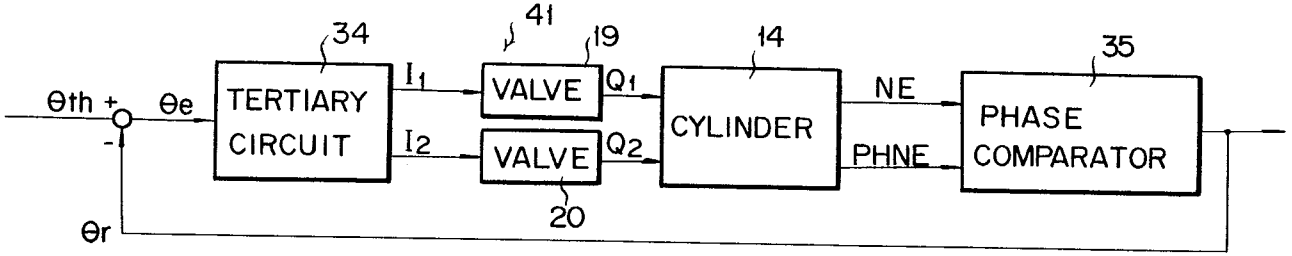
FIG. 3 is a block diagram having a piston-cylinder assembly control mechanism in the same embodiment.

FIG. 3 shows a piston-cylinder assembly control mechanism 41. It includes a tertiary circuit 34 and a phase comparator 35. The tertiary circuit 34 is coupled through the three-way valves 19 and 20 to the cylinder 14, which is in turn coupled to the phase comparator 35.

Figure 4:
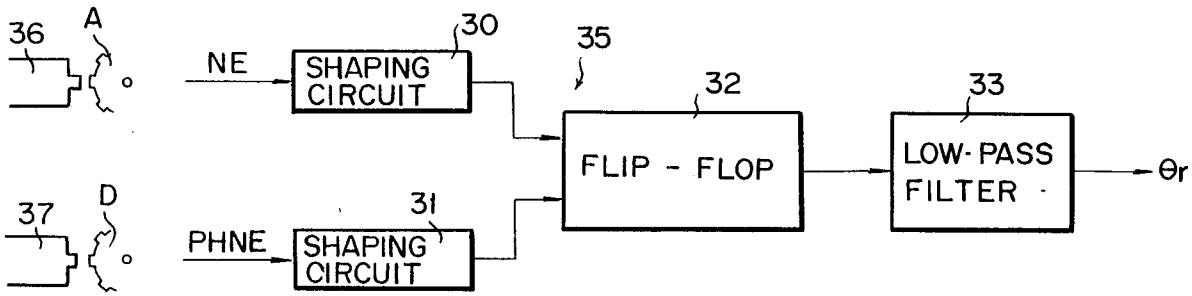
FIG. 4 is a block diagram showing a phase comparator shown in FIG. 3.
Figure 5:
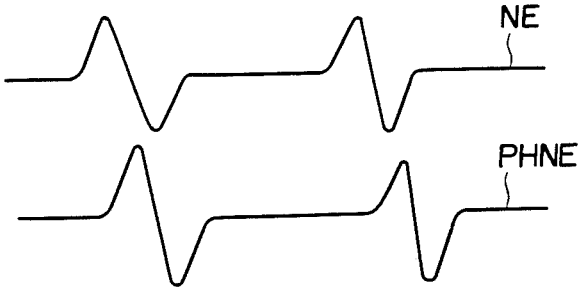
FIG. 5 is a waveform diagram showing gear phase detection outputs representing the phases of first and fourth gears.

FIG. 4 shows the phase comparator in detail. It includes electromagnetic pick-ups 36 and 37. The pick-up 36 detects the phase of first gear A and produces an output having a corresponding waveform. The pick-up 37 detects the phase of the fourth gear D and produces an output having a corresponding waveform. The phase comparator 35 further includes shaping circuits 30 and 31, a flip-flop 32 and a low-pass filter 33. FIG. 5 shows the outputs NE and PHNE of the respective electromagnetic pick-ups 30 and 31.

In operation for phase comparison, the outputs NE and PHNE of the electromagnetic pick-ups 30 and 31 are shaped through the shaping circuits 30 and 31 to obtain corresponding rectangular waves. The flip-flop 32 is set and reset in synchronism to the falling edge of the rectangular waveform outputs of shaping circuits 30 and 31 to produce an output having a pulse duration proportional to the phase difference between the outputs NE and PHNE.

This pulse duration output is fed to the low-pass filter 33 to obtain a phase difference analog output $\theta_R$.

The three-way valves 19 and 20 are operated according to the difference $\theta e$ between a preset phase angle $\theta_{th}$ and the actual phase angle $\theta_r$, whereby the flow of the operating fluid into and out of the head side and rod side sections of the cylinder 14 to position the piston 15. The positioning of the piston 15 obtained in this way determines the phase difference between the input and output shafts 7 and 4.

To be more specific, the three-way valves 19 and 20 are switched to establish a circuit, in which the oil hydraulic driving pressure is led through the three-way valve 19 to the head side section 23 of the piston-cylinder assembly while the operating fluid in the rod side section 25 is returned through the other three-way valve 20 to the tank, the drive piston 15 is displaced to the right. When the converse circuit is established, the drive piston 15 is displaced to the left. Further, when both the three-way valves 19 and 20 are such that the oil hydraulic driving pressure is led to them, the drive piston 15 is stopped.

With the operation of the piston-cylinder assembly 12 as described above, the shaft 8 can be displaced to displace the second and third gears B and C.

Since either one of the fourth and first gears D and A is a helical gear or both these gears are helical gears, with the displacement of the second and third gears B and C the rotational phase relation between the first and fourth gears A and D is varied to vary the phase relation between the input and output shafts 7 and 4, thus varying the fuel injection timing.

Figure 6:
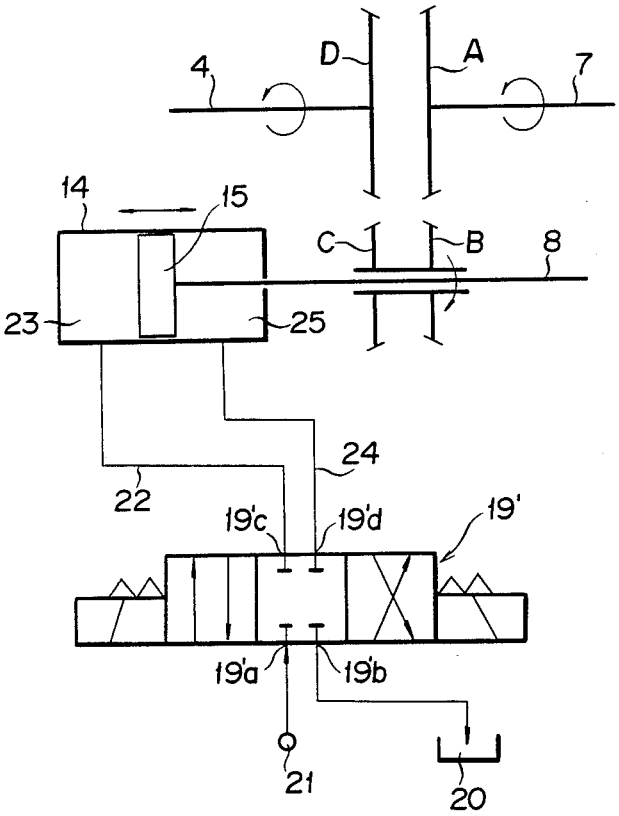
FIG. 6 is a schematic view showing a different embodiment of the invention.

FIG. 6 shows a different embodiment of the invention. In this instance, a three-position four-way solenoid valve 19' is employed in lieu of the three-way valves 19 and 20 in the previous embodiment. It has an inlet port 19'*a*, a relief port 19'*b* and two outlet ports 19'*c* and 19'*d*. The inlet port 19'*a* is communicated with oil hydraulic driving pressure source 21, the relief port 19'*b* is communicated with tank, the outlet port 19'*c* is communicated with rod side section 23 of piston-cylinder assembly through duct line 22, and the outlet port 19'*d* is communicated with head side section 25 of the piston-cylinder assembly 12 through duct line 24.

When the four-way solenoid valve 19' is switched to the right position, the oil hydraulic driving pressure is led to the head side section 23 of the piston-cylinder assembly 12, while the operating fluid in the rod side section 25 is returned to the tank. At this time, the drive piston 15 is displaced to the right. When the converse circuit is established, the drive piston 15 is displaced to the left. When the four-way solenoid valve 19' is switched to the center position to close all its ports, the drive piston 15 is stopped.

As has been described in the foregoing, the fuel injection timing control apparatus according to the invention comprises the fuel injection timing control mechanism 40 having the body 1 supporting the input and output shafts 7 and 4 respectively carrying the first and fourth gears A and D, the output shaft 4 being coupled to a fuel injection mechanism, the axially movable shaft 8 extending parallel with the input and output shafts 7 and 4 and carrying the second and third gears B and C in mesh with the respective first and fourth gears A and D, at least either one of the first and fourth gears A and D being a helical gear, the piston-cylinder assembly 12 provided in the body 1 and having the piston rod coupled to the axially movable shaft 8, and the piston-cylinder assembly control mechanism 41 including the two detectors for detecting the phases of the first and fourth gears A and D and obtaining the phase difference output representing the actual phase angle $\theta_r$ from the two gear phase detection outputs and solenoid valve means controlled according to the difference $\theta e$ between the preset phase angle $\theta_{th}$ and actual phase angle $\theta_r$ to control the flow of operating fluid into and out of the piston-cylinder assembly 12. With this construction, the phase relation between the first and fourth gears A and D in the fuel injection timing control mechanism is varied with the displacement of the second and third gears B and C with the axially movable shaft 8 through the control of the piston-cylinder assembly 12 by the piston-cylinder assembly control mechanism according to the difference $\theta e$ between the preset phase angle $\theta_{th}$ and actual phase angle $\theta_r$. Thus, it is possible to obtain reliable and accurate fuel injection timing control.

What is claimed is:

1. An apparatus for controlling fuel injection timing, comprising:

a fuel injection timing control mechanism including a body supporting an input shaft with a first gear secured thereto, an output shaft with a fourth gear secured thereto and an axially movable shaft extending parallel to said input and output shafts and having a second and a third gear secured thereto, said second and third gears being respectively in mesh with said first and fourth gears, at least one of said first and fourth gears being a helical gear;

a piston-cylinder assembly having a piston rod coupled to said axially movable shaft; and means for controlling the operation of said piston-cylinder assembly, said means including detector means for directly detecting the phases of said first and fourth gears by monitoring said first and fourth gears, means for obtaining detected phase angle data from the output of said detector means and solenoid-operated valve means controlled according to the difference between reference phase angle data and said detected phase angle data to control the flow of operating fluid into and out of said piston-cylinder assembly, said solenoid-operated valve means including a first and a second three-way solenoid-operated valve each having an inlet port communicated with a hydraulic driving pressure source, said first three-way solenoid-operated valve having a first outlet port communicated with a head side section of said piston-cylinder assembly and a second outlet port communicated with a tank, said second three-way solenoid-operated valve having first outlet port communicated with a rod side section of said piston-cylinder assembly and a second outlet port communicated with said tank.

2. An apparatus for controlling fuel injection timing, comprising:

a fuel injection timing control mechanism including a body supporting an input shaft with a first gear secured thereto, an output shaft with a fourth gear secured thereto and an axially movable shaft extending parallel to said input and output shafts and having a second and a third gear secured thereto, said second and third gears being respectively in mesh with said first and fourth gears, at least one of said first and fourth gears being a helical gear;

a piston-cylinder assembly having a piston rod coupled to said axially movable shaft; and means for controlling the operation of said piston-cylinder assembly, said means including detector means for directly detecting the phases of said first and fourth gears by monitoring said first and fourth gears, means for obtaining detected phase angle data from the output of said detector means and solenoid-operated valve means controlled according to the difference between reference phase angle data and said detected phase angle data to control the flow of operating fluid into and out of said piston-cylinder assembly, said solenoid-operated valve means comprises a three-position four-way solenoid-operated valve having an inlet port communicated with a hydraulic driving pressure source, a relief port communicated with a tank, a first outlet port communicated with a rod side section of said piston-cylinder assembly and a second outlet port communicated with a head side section of said piston-cylinder assembly.

* * * * *